US011242585B2

(12) United States Patent
Wang et al.

(10) Patent No.: US 11,242,585 B2
(45) Date of Patent: Feb. 8, 2022

(54) IRON-BASED SUPERALLOY FOR HIGH TEMPERATURE 700 ° C. WITH COHERENT PRECIPITATION OF CUBOIDAL B2 NANOPARTICLES

(71) Applicant: DALIAN UNIVERSITY OF TECHNOLOGY, Liaoning (CN)

(72) Inventors: Qing Wang, Liaoning (CN); Zhenhua Wang, Liaoning (CN); Chuang Dong, Liaoning (CN)

(73) Assignee: Dalian University of Technology, Liaoning (CN)

( * ) Notice: Subject to any disclaimer, the term of this patent is extended or adjusted under 35 U.S.C. 154(b) by 0 days.

(21) Appl. No.: 17/343,408

(22) Filed: Jun. 9, 2021

(65) Prior Publication Data

US 2021/0395869 A1 Dec. 23, 2021

(30) Foreign Application Priority Data

Jun. 17, 2020 (CN) ..... 202010554765.5

(51) Int. Cl.

| | |
|---|---|
| ***C22C 38/54*** | (2006.01) |
| ***C22C 38/50*** | (2006.01) |
| ***C22C 38/06*** | (2006.01) |
| ***C22C 38/44*** | (2006.01) |
| ***C22C 33/04*** | (2006.01) |

(52) U.S. Cl.

CPC ..... *C22C 38/54* (2013.01); *C22C 33/04* (2013.01); *C22C 38/06* (2013.01); *C22C 38/44* (2013.01); *C22C 38/50* (2013.01); *C22C 2200/04* (2013.01)

(58) Field of Classification Search

None

See application file for complete search history.

(56) References Cited

FOREIGN PATENT DOCUMENTS

CN 106381452 A * 2/2017

OTHER PUBLICATIONS

Office Action (with English translation) corresponding to Chinese application No. 202010554765.5 dated Feb. 8, 2021. (pp. 10).

Response to Office Action (with English translation) corresponding to Chinese application No. 202010554765.5 dated Mar. 18, 2021. (pp. 14).

(Continued)

*Primary Examiner* — Jenny R Wu

(74) *Attorney, Agent, or Firm* — Muncy, Geissler, Olds & Lowe, P.C.

(57) ABSTRACT

An iron-based superalloy for high temperature 700° C. with coherent precipitation of cuboidal B2 nanoparticles, belongs to the field of heat-resistant stainless steel, including Fe, Cr, Ni, Al, Mo, W, Zr, B elements. C, Si, Mn, S, P, O, N are impurity elements. The weight percent (wt. %) of its alloy composition is Cr: 10.0~12.0, Ni: 13.0~15.0, Al: 6.0~7.0, Mo: 2.0~3.0, W: 0.3~0.7, Zr: 0.03~0.05, B: 0.004~0.007, C≤0.02, Si≤0.20, Mn≤0.20, S≤0.01, P≤0.02, O≤0.005, N≤0.02, Fe: balance; and the atomic percent ratio of Zr/B is 1:1, the atomic percent ratio of Cr/(Mo+W) is 8:1, and the atomic percent ratio of Mo/W is 8:1. The coherent precipitation of cuboidal B2 nanoparticles in ferritic matrix through the alloy composition design.

1 Claim, 1 Drawing Sheet

(56) References Cited

OTHER PUBLICATIONS

Notification of Grant (with English translation) corresponding to Chinese application No. 202010554765.5 dated Apr. 29, 2021. (pp. 5).
SISHU; "Coherent Precipitation and Strengthening in Body-Centered-Cubic-based Multi-component Alloys", Materials Rep011s, 2020, vol. 34, No. 4, pp. 07130-07137. (pp. 8).

* cited by examiner

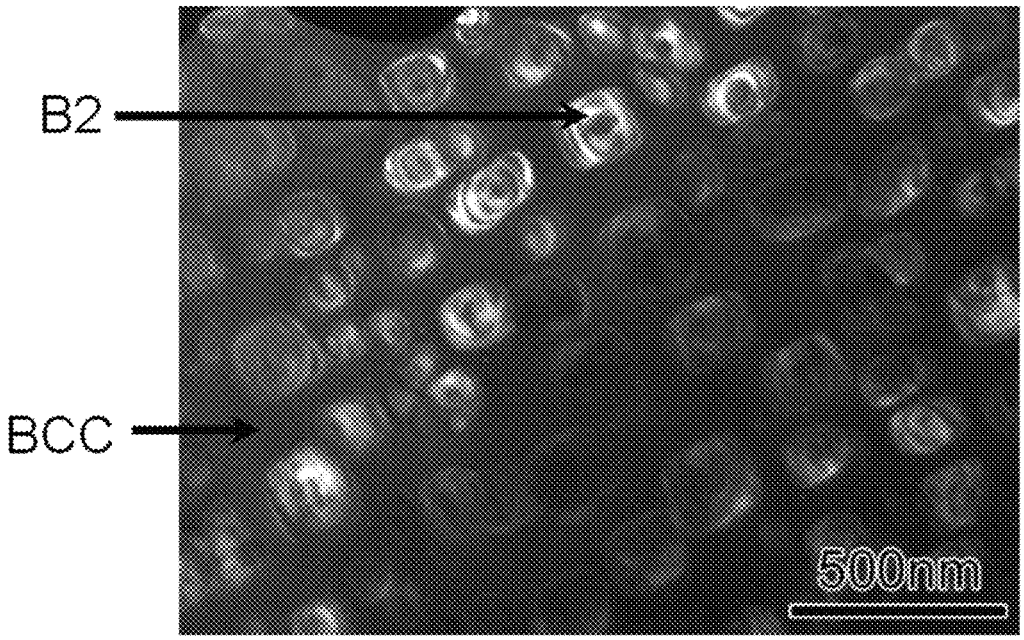
B2
BCC
500nm

IRON-BASED SUPERALLOY FOR HIGH TEMPERATURE 700 ° C. WITH COHERENT PRECIPITATION OF CUBOIDAL B2 NANOPARTICLES

FIELD OF THE INVENTION

The present invention belongs to the field of heat-resistant stainless steel, and in particular relates to an iron-based superalloy for high temperature 700° C. with coherent precipitation of cuboidal B2 nanoparticles.

BACKGROUND OF THE INVENTION

The mechanical properties of high-performance engineering alloys are closely related to their microstructure, especially the high-temperature strength, which is mainly controlled by the morphology, size and distribution of the second-phase particles precipitated on the solid-solution matrix. Conventional body-centered cubic (BCC) iron-based superalloys (including ferrite and martensite) have gained widespread attention due to their high strength, high thermal conductivity, low thermal expansion coefficient, and good corrosion resistance. In these superalloys, the second phases used to strengthen the BCC matrix are mainly carbides (MC, $M_{23}C_6$, etc.) and intermetallic compounds ($Ni_3M$, Laves-$Fe_2M$ phase, G-$Ni_{16}Nb_6Si_7$ phase, Z—CrNbN phase). The crystal structures and lattice constants of these precipitated phases differ greatly from those of the BCC solid solution matrix. So, the precipitated phase particles can only maintain a semi-coherent or non-coherent interfacial relationship with the BCC matrix. In addition, during long-term aging or high-temperature creep, both semi-coherent and non-coherent precipitated second-phase particles tend to grow and coarsen in the direction of low misfit. In the conventional ferritic/martensitic (F/M) heat-resistant steel T92/P92 (Fe-9Cr-0.5Mo-1.8W-0.2V-0.1C wt. %), the carbide particles in the matrix are severely coarsened at service temperatures above 650° C., which seriously degrades the mechanical properties of this alloy, especially its high-temperature strength.

Different from traditional Fe-based superalloys, Ni-based superalloys exhibit excellent mechanical properties at high temperatures unmatched by other alloys, mainly due to their unique microstructure, i.e., the cuboidal ordered phase γ' particles are coherently precipitated in the solid solution γ matrix. These superalloys are complex alloys with more than ten trace alloying elements added to adjust the misfit between the matrix and the precipitated particles, thus achieving the coherent precipitation of cuboidal nanoparticles. Similarly, in Al-containing Fe-based superalloys, the coherent precipitation of spherical ordered-phase B2 nanoparticles in a body-centered cubic BCC solid-solution matrix also improves the high-temperature creep properties of the alloy to some extent. However, it is shown that only the cuboidal coherent precipitation can ensure the maximum enhancement of the high-temperature strength of the alloy. But this kind of organization is difficult to appear in B2-reinforced BCC Fe-based superalloys. Essentially, because the ordered B2 phase is usually located in the middle of the phase diagram and has a large difference in composition from the BCC phase, it is difficult to adjust the misfit between the two phases. This indicates that the alloying elements in such Al-containing Fe-based superalloys need further adjustment and optimization in order to achieve the coherent precipitation of cuboidal B2 nanoparticles form in the BCC matrix, i.e., the ideal microstructure of the high-temperature alloy, as a way to improve the high-temperature mechanical properties of the alloy.

Therefore, it is difficult to achieve coherent precipitation of cuboidal B2 nanoparticles in BCC iron-based high-temperature superalloys, which has become a bottleneck in the development of iron-based superalloys. In view of this, the present invention provides an iron-based superalloy for high temperature 700° C. with coherent precipitation of cuboidal B2 nanoparticles. It has a unique microstructure with coherent precipitation of cuboidal B2 nanoparticles in the BCC matrix, which will enable the alloy to be applied in high-temperature 700° C. environment and exhibit good microstructural stability and high strength at high temperatures.

SUMMARY OF THE INVENTION

The present invention designs and develops an iron-based superalloy for high temperature 700° C. with coherent precipitation of cuboidal B2 nanoparticles. The purpose of the present invention is to design an iron-based superalloy with good high-temperature microstructure stability and high strength by achieving coherent precipitation of cuboidal B2 nanoparticles in a BCC ferritic matrix.

The technical solution of the present invention is as follows:

An iron-based superalloy for high temperature 700° C. with coherent precipitation of cuboidal B2 nanoparticles, includes Fe, Cr, Ni, Al, Mo, W, Zr, B elements, C, Si, Mn, S, P, O, N are impurity elements, and the weight percent (wt. %) of the alloy composition are Cr: 10.0~12.0, Ni: 13.0~15.0, Al: 6.0~7.0, Mo: 2.0~3.0, W: 0.3~0.7, Zr: 0.03~0.05, B: 0.004~0.007, C≤0.02, Si≤0.20, Mn≤0.20, S≤0.01, P≤0.02, O≤0.005, N≤0.02, Fe: balance; and the atomic percent ratio of Zr/B is 1:1; the atomic percent ratio of Cr/(Mo+W) is 8:1; and the atomic percent ratio of Mo/W is 8:1.

In addition, the iron-based superalloy has a specific microstructure: cuboidal B2 nanoparticles coherent precipitated in the BCC ferritic matrix, which makes the iron-based superalloy exhibit good high-temperature microstructural stability and high strength at high temperature of 700° C.

The conception to realize the above technical solution is as following: Design the composition of iron-based superalloys using the applicant's cluster compositional formula design method. The compositional design method is based on the "cluster+glue atoms" structural model, which divides the stable solid solution structure into two parts: clusters and glue atoms. Cluster are nearest-neighbor coordination polyhedra centered on a certain atom. The glue atoms are placed in the interstices of the cluster stacks, usually in the next nearest neighboring shell layer of the cluster. In this way, a simple cluster composition formula [cluster](glue atoms)$_x$ can be determined, i.e. a cluster is matched to x glue atoms. This cluster compositional design method has been successfully applied to the design of various engineering alloys such as austenitic stainless steel for high temperature and low-elastic β-Ti alloys, providing a new way of thinking and method to carry out the design and optimization of alloy composition.

According to the applicant's previous work, in the Fe—Cr—Ni—Al quaternary alloy system, Al has a strong interaction with the other three alloying elements, and the interaction of the other three alloying elements is weak. Therefore, when the cluster compositional approach is used to design the alloy, Al occupies the central atomic position, while Fe, Ni, and Cr atoms occupy the shell and glue atomic positions; it should be noted that when the Al content is high, Al also occupies the glue atomic positions, resulting in $[Al—(Fe,Ni,Cr)_{14}]Al_1$. And considering the precipitation of B2-NiAl phase and BCC structure stability, the base cluster formula of the iron-based superalloy was finally determined as $[Al—Fe_{10}Ni_2Cr_2]Al_1$.

The addition of Mo and W elements can improve the pitting resistance of steel while playing a solid solution strengthening role. Moreover, in the Fe—Cr—Ni—Al quaternary system, the addition of Mo and W elements can also increase the lattice constants of the BCC matrix, thus reducing the lattice misfit between the BCC matrix and the precipitated phase B2, which is more favorable to the co-lattice precipitation of cuboidal B2 nanoparticles. Therefore, the addition of Mo and W replaces the Cr element in the cluster formula according to the atomic ratio of Cr/(Mo+W) of 8:1, while satisfying the Mo/W atomic ratio of 8:1. The addition of trace elements of B (0.004~0.007 wt. %) with the same molar ratio of Zr element can improve the grain boundary cohesion and increase the high temperature strength of this alloy. In addition, the B element can also segregate near the grain boundaries, thus inhibiting the precipitation of σ-FeCr and other grain boundary detrimental phases. Finally, we determined the composition of an iron-based superalloy for high temperature 700° C. with coherent precipitation of cuboidal B2 nanoparticles as Fe-(10.0~12.0)Cr-(13.0~15.0)Ni-(6.0~7.0)Al-(2.0~3.0)Mo-(0.3~0.7)W-(0.03~0.05)Zr-(0.004~0.007)B; And C, Si, Mn, S, P, O, N are impurity elements: C≤0.02, Si≤0.20, Mn≤0.20, S≤0.01, P≤0.02, O≤0.005, N≤0.02 (wt. %).

The method of preparation of the invention is as follows: According to the mass percentage, the ingredients are prepared using high purity metal. The 15 g of the mixture is placed in the water-cooled copper crucible of the arc melting furnace and melted under the protection of argon atmosphere using the non-self-consuming arc melting method. And the ingots are so repeatedly melted at least five times to obtain alloy ingots of uniform composition. Then the uniformly melted alloy ingots are melted and the melt is drawn into the cylindrical copper model cavity using the copper mold suction casting process to obtain rods with a diameter of 6 mm. The alloy bars were then homogenized at 1200° C. for 2 h and finally aged at 700° C. for 0.5~48 h. The alloy structure and structure were examined using optical microscopy (OM), scanning electron microscopy (SEM), transmission electron microscopy (TEM) and X-ray diffractometry (XRD, Cu Kα radiation, λ=0.15406 nm) to examine the microstructure and structure of the alloy; The hardness tests of the series of alloys under different heat-treatment states is conducted using HVS-1000 Vickers hardness tester; and room temperature and high temperature tensile mechanical properties are conducted using UTM5504 electronic universal tensile tester. Thus, the invention was identified as an iron-based superalloy for high temperature 700° C. with coherent precipitation of cuboidal B2 nanoparticles as described above. and the weight percent (wt. %) of its alloy composition is Cr: 10.0~12.0, Ni: 13.0~15.0, Al: 6.0~7.0, Mo: 2.0~3.0, W: 0.3~0.7, Zr: 0.03~0.05, B: 0.004~0.007, C≤0.02, Si≤0.20, Mn≤0.20, S≤0.01, P≤0.02, O≤0.005, N≤0.02, Fe: balance; and the atomic percent ratio of Zr/B is 1:1; the atomic percent ratio of Cr/(Mo+W) is 8:1; and the atomic percent ratio of Mo/W is 8:1. The microstructure and properties of the material were tested as follows: Room temperature mechanical properties of the alloy are hardness HV=360-520 $kg \cdot mm^{-2}$ and tensile strength $\sigma_b$=1200-1700 MPa; high temperature mechanical properties of the alloy at 700° C. are yield strength $\sigma_s$=230-270 MPa and tensile strength $\sigma_b$=300-350 MPa. After aging at 700° C. for 0.5~48 h, the alloy exhibits cuboidal B2 nanoparticles coherently precipitated in the BCC ferritic matrix and possesses good stability of BCC/B2 coherent microstructure after long-term aging. Therefore, the modified claims of this application solve the above technical problems.

Compared with existing technology, the beneficial effect of the present invention is as following: The present invention is designed and developed based on our self-developed cluster composition method for an iron-based superalloy for high temperature 700° C. with coherent precipitation of cuboidal B2 nanoparticles. Unlike conventional iron-based superalloys that use non-coherent or semi-coherent precipitation strengthening, the present invention uses a new concept of coherent precipitation strengthening. It can maximize the high-temperature mechanical properties of the alloy by coherent precipitation of cuboidal B2 nanoparticles in the ferritic matrix, achieving the purpose of high strength and good plasticity at high temperature. The typical properties indexes are: room temperature mechanical properties of the alloy are hardness HV=360-520 $kg \cdot mm^{-2}$ and tensile strength $\sigma_b$=1200-1700 MPa; high temperature mechanical properties of the alloy at 700° C. are yield strength $\sigma_s$=230-270 MPa and tensile strength $\sigma_b$=300-350 MPa.

The beneficial effects of the present invention: ① An iron-based superalloy for high temperature 700° C. with coherent precipitation of cuboidal B2 nanoparticles is developed, and the weight percent (wt. %) of its alloy composition is Cr: 10.0~12.0, Ni: 13.0~15.0, Al: 6.0~7.0, Mo: 2.0~3.0, W: 0.3~0.7, Zr: 0.03~0.05, B: 0.004~0.007, C≤0.02, Si≤0.20, Mn≤0.20, S≤0.01, P≤0.02, O≤0.005, N≤0.02, Fe: balance; ② the alloy melting and preparation process is simple; ③ The maximum enhancement of the high-temperature mechanical properties of this alloy is achieved by coherent precipitation strengthening of cuboidal B2 nanoparticles.

BRIEF DESCRIPTION OF DRAWINGS

The FIGURE is the TEM image of Fe-10.92Cr-13.87Ni-6.38A1-2.24Mo-0.54W-0.042Zr-0.005B (wt. %) alloy prepared in Example 1, showing coherent precipitation of cuboidal B2 nanoparticles in a ferrite matrix.

DETAILED DESCRIPTION

The specific implementation of the invention is described in detail below in combination with technical solutions.

Example 1 Fe-10.92Cr-13.87Ni-6.38Al-2.24Mo-0.54W-0.042Zr-0.005B (Wt. %) Alloy Step 1: Preparation of Alloy According to the mass percentage, the ingredients were prepared using high purity metal. The 15 g of the mixture was placed in the water-cooled copper crucible of the arc melting furnace and melted under the protection of argon atmosphere using the non-self-consuming arc melting method. And the ingots were so repeatedly melted at least five times to obtain alloy ingots of uniform composition. Then the uniformly melted alloy ingots were melted and the melt is drawn into the cylindrical copper model cavity using the copper mold suction casting process to obtain rods with a diameter of 6 mm. The alloy bars were then homogenized at 1200° C. for 2 h and finally aged at 700° C. for 24 h.

Step 2: The Microstructure and Mechanical Properties of the Alloy were Tested

OM, SEM and XRD were used to examine the Microstructure of the alloy after aged treatment, and the results showed that the alloy matrix of the present invention is ferrite, and the cuboidal B2 nanoparticles are coherently precipitated in the ferrittic matrix, see shown in the FIGURE. Even after long-term aging, it still maintains good stability of BCC/B2 coherent precipitation; Room temperature hardness test was conducted using Vickers hardness tester HV=380 kgf·mm$^{-2}$. The mechanical properties of the alloy at room temperature and high temperature were measured using the UTM5504 electronic universal tensile tester: room temperature mechanical properties of the alloy were tensile strength $\sigma_b$=1230 MPa; high temperature mechanical properties of the alloy at 700° C., yield strength $\sigma_s$=253 MPa, tensile strength $\sigma_b$=320 MPa.

Example 2
Fe-10Cr-15Ni-6Al-3Mo-0.7W-0.03Zr-0.004B (Wt. %) Alloy

Step 1: Preparation of Alloy

According to the mass percentage, the ingredients were prepared using high purity metal. The 15 g of the mixture was placed in the water-cooled copper crucible of the arc melting furnace and melted under the protection of argon atmosphere using the non-self-consuming arc melting method. And the ingots were so repeatedly melted at least five times to obtain alloy ingots of uniform composition. Then the uniformly melted alloy ingots were melted and the melt is drawn into the cylindrical copper model cavity using the copper mold suction casting process to obtain rods with a diameter of 6 mm. The alloy bars were then homogenized at 1200° C. for 2 h and finally aged at 700° C. for 0.5 h.

Step 2: The Microstructure and Mechanical Properties of the Alloy were Tested

OM, SEM and XRD were used to examine the Microstructure of the alloy after aged treatment, and the results showed that the alloy matrix of the present invention is ferrite, and the cuboidal B2 nanoparticles are coherently precipitated in the ferrittic matrix, see shown in the FIGURE. Even after long-term aging, it still maintains good stability of BCC/B2 coherent precipitation; Room temperature hardness test was conducted using Vickers hardness tester HV=480 kgf·mm$^{-2}$. The mechanical properties of the alloy at room temperature and high temperature were measured using the UTM5504 electronic universal tensile tester: room temperature mechanical properties of the alloy were tensile strength $\sigma_b$=1690 MPa; high temperature mechanical properties of the alloy at 700° C., yield strength $\sigma_s$=265 MPa, tensile strength $\sigma_b$=348 MPa.

Example 3
Fe-12.0Cr-13.0Ni-7.0Al-2Mo-0.3W-0.05Zr-0.007B (wt. %) Alloy

Step 1: Preparation of Alloy

According to the mass percentage, the ingredients were prepared using high purity metal. The 15 g of the mixture was placed in the water-cooled copper crucible of the arc melting furnace and melted under the protection of argon atmosphere using the non-self-consuming arc melting method. And the ingots were so repeatedly melted at least five times to obtain alloy ingots of uniform composition. Then the uniformly melted alloy ingots were melted and the melt is drawn into the cylindrical copper model cavity using the copper mold suction casting process to obtain rods with a diameter of 6 mm. The alloy bars were then homogenized at 1200° C. for 2 h and finally aged at 700° C. for 48 h.

Step 2: The Microstructure and Mechanical Properties of the Alloy were Tested

OM, SEM and XRD were used to examine the Microstructure of the alloy after aged treatment, and the results showed that the alloy matrix of the present invention is ferrite, and the cuboidal B2 nanoparticles are coherently precipitated in the ferrittic matrix, see shown in the FIGURE. Even after long-term aging, it still maintains good stability of BCC/B2 coherent precipitation; Room temperature hardness test was conducted using Vickers hardness tester HV=364 kgf·mm$^{-2}$. The mechanical properties of the alloy at room temperature and high temperature were measured using the UTM5504 electronic universal tensile tester: room temperature mechanical properties of the alloy were tensile strength $\sigma_b$=1247 MPa; high temperature mechanical properties of the alloy at 700° C., yield strength $\sigma_s$=237 MPa, tensile strength $\sigma_b$=306 MPa.

The above described examples only express the way of implementation of the present invention, but they should not be understood as a limitation of the scope of the patent of the present invention, and it should be noted that for the technicians in the field, a number of deformations and improvements can be made without departing from the conception of the present invention, which all belong to the scope of protection of the present invention.

The invention claimed is:

1. An iron-based superalloy for high temperature 700° C. with coherent precipitation of cuboidal B2 nanoparticles, wherein the iron-based superalloy for high temperature of 700° C. includes Fe, Cr, Ni, Al, Mo, W, Zr, B elements, C, Si, Mn, S, P, O, N are impurity elements, and weight percent (wt. %) of alloy composition are Cr: 10.0~12.0, Ni: 13.0~15.0, Al: 6.0~7.0, Mo: 2.0~3.0, W: 0.3~0.7, Zr: 0.03~0.05, B: 0.004~0.007, C≤0.02, Si≤0.20, Mn≤0.20, S≤0.01, P≤0.02, O≤0.005, N≤0.02, Fe: balance; and atomic percent ratio of Zr/B is 1:1; atomic percent ratio of Cr/(Mo+W) is 8:1; and atomic percent ratio of Mo/W is 8:1;

wherein the iron-based superalloy has a specific microstructure: cuboidal B2 nanoparticles coherent precipitated in BCC ferritic matrix.

* * * * *